United States Patent [19]

Cardini

[11] 4,434,942

[45] Mar. 6, 1984

[54] PROCESS AND APPARATUS FOR ATTRITION CARRIED OUT IN A HUMID MEDIUM

[75] Inventor: Jean-Louis Cardini, Paris, France

[73] Assignee: Societe Metallurgique Le Nickels-S.L.N., Paris, France

[21] Appl. No.: 333,751

[22] Filed: Dec. 23, 1981

Related U.S. Application Data

[63] Continuation of Ser. No. 94,085, Nov. 14, 1979, abandoned.

[30] Foreign Application Priority Data

Nov. 15, 1978 [FR] France ..... 78 32217

[51] Int. Cl.[3] ..... B02C 17/16

[52] U.S. Cl. ..... 241/21; 241/26; 241/29; 241/46.11; 241/46.17; 241/152 R; 241/284

[58] Field of Search ..... 241/21, 46.11, 46.17, 241/154, 157, 172, 26, 30, 29, 284, 152 R

[56] References Cited

U.S. PATENT DOCUMENTS

| | | | |
|---|---|---|---|
| 1,741,063 | 12/1929 | Mason . | |
| 2,136,726 | 11/1938 | Osborne . | |
| 2,464,588 | 3/1949 | Knudsen et al. | 241/46.17 |
| 2,562,024 | 7/1951 | Dunn et al. | 241/14 |
| 3,404,870 | 10/1968 | Multer | 259/43 |
| 4,175,790 | 0/0000 | Predali . | |

FOREIGN PATENT DOCUMENTS

| | | |
|---|---|---|
| 2021881 | 2/1971 | Fed. Rep. of Germany . |
| 2250098 | 5/1973 | Fed. Rep. of Germany . |
| 566687 | 1/1945 | United Kingdom . |
| 411903 | 1/1974 | U.S.S.R. . |
| 520130 | 9/1976 | U.S.S.R. . |

*Primary Examiner*—Mark Rosenbaum

*Attorney, Agent, or Firm*—Fleit, Jacobson, Cohn & Price

[57] ABSTRACT

This invention provides a process and apparatus for the wet attrition of ore. The process comprises grinding the ore to a pulp having a particle size distribution such that about 80% by weight of the particles have a diameter of from about 30 to about 0.4 mm; and agitating the pulp in a slightly turbulent medium. The apparatus comprises a vat having top and bottom covers with central openings and a gutter disposed along the exterior circumference of the top of the vat; a cylindrical shaft extending through the opening in the top cover; and a pair of impellers mounted at a distance apart on the shaft, the blades of the impellers being so arranged that the pulp is pumped towards the space defined between the two impellers.

18 Claims, 3 Drawing Figures

FIG. 1
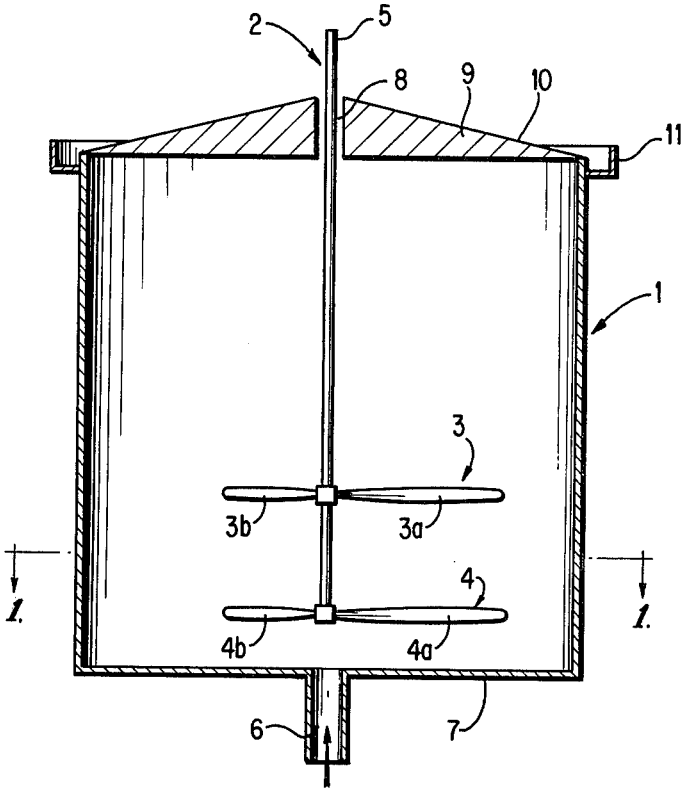
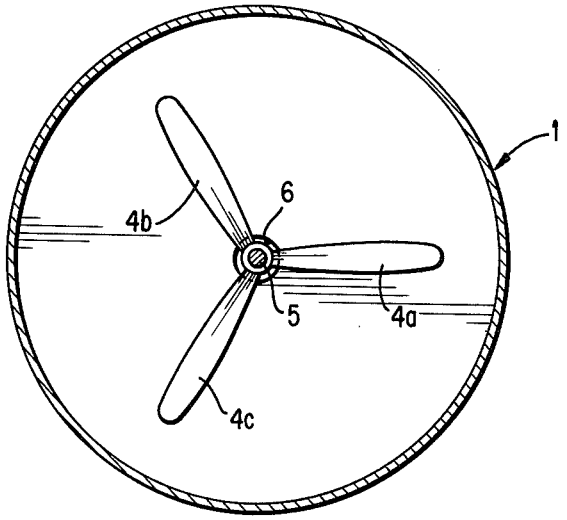
FIG. 2

PROCESS AND APPARATUS FOR ATTRITION CARRIED OUT IN A HUMID MEDIUM

This is a continuation of application Ser. No. 94,085 filed Nov. 14, 1979, now abandoned.

BACKGROUND OF THE INVENTION

1. Field of the Invention

The present invention relates to a process of attrition which is carried out in a humid medium. More specifically, this invention relates to a process for the attrition of previously ground ores. It also relates to an apparatus for carrying out this process.

2. Description of the Prior Art

Attrition through a humid (wet) method consists of submitting ore grains which are dispersed in water to friction and blows, the force of which is too weak to produce grinding, but nevertheless sufficiently high to free the softest portions. These portions are recovered in the aqueous phase in the form of very fine particles. The attrition not only permits the separation of the soft particles, but also it produces new particles from the friction and blows among the particles.

Certain industries currently employ a different technique, which is also called attrition, but this does not create new particles. This is especially the case in the glassmaking industry where a technique called attrition is used to wash sand, in this case, only a separation is sought.

In addition, these techniques, which are improperly called attrition, do not produce satisfactory results when one wishes to treat materials such as, for example, a nickel ore. Furthermore, they consume large amounts of energy. In the case of attrition of a nickel ore, for instance, it is necessary to use 80 kilowatts per ton of ore treated to obtain a return of 30% in weight of particles created by attrition.

SUMMARY OF THE INVENTION

It is an objective of the present invention to supply an attrition process which permits not only the separation of the soft portion of the ore but also the creation of new, very fine particles.

Another objective of the invention is to provide a process which involves an energy consumption lower than that of the known attrition processes.

It is still another objective of this invention to provide an apparatus which may be used in the above-mentioned process.

BRIEF DESCRIPTION OF THE INVENTION

These objectives, as well as others which will appear in due course, are attained by the process of the present invention, according to which the ore is preground into a pulp wherein the particle diameter ranges from about 30 to about 0.4 mm. This pulp is then agitated in a slightly turbulent medium. By "slightly turbulent," it is meant that the impeller Reynolds number, defined as:

$$N_{ReImp}=(U\times d\times \rho)/\mu$$

wherein

U = rotational speed of impeller, rpm;

d = diameter of impeller, cm;

$\rho$ = density of pulp, gm/cm$^3$; and $\mu$ = viscosity of pulp, centipoise.

is within the range of from about 1,000 to about 5,000, preferably from about 2,000 to about 4,000.

Preferably, the agitation is carried out in a slightly turbulent medium by means of a pair of impellers designed so that the pulp moves from one impeller towards the other.

Advantageously the dryness of the pulp, that is the weight percentage of the dry matter of the pulp, is at least equal to about 50% and even higher than about 70%, preferably from about 65% to about 78%.

The apparatus of the present invention includes a vat, the cross section of which is a circle or a polygon having at least six sides, preferably 10 to 12 sides; an axial agitator furnished with at least two impellers having horizontally disposed blades; and injection and recovery conduits which open into the vat as close as possible to the axial agitator.

Advantageously, the impellers are arranged so that the upper one causes the pulp to move toward the bottom of the vat while the lower one causes the pulp to move toward the top of the vat.

Preferably these impellers have a carrying coefficient substantially constant throughout their length, i.e. the voluminal flow rate per area element is constant whatever the position of this area element within the area produced by the rotation of each impeller.

The ratio of the areas of the total surface of the vat to the total surface of the circle produced by the rotation of the two impellers is between about 1.7 and about 2.4 and, preferably, between about 1.9 and about 2.1.

The vertical distance between the pair of impellers is from about 0.3 to about 0.7 times, preferably from about 0.4 to about 0.6 times, the diameter of the circle produced by the rotation of these impellers.

Preferably, the vertical distance between the lower impeller and the bottom of the vat is substantially equal to about one-quarter of the diameter of the circle produced by the rotation of the impellers.

As for the distance between the upper impeller and the top of the vat, it is, advantageously, substantially equal to half of the diameter of the circle produced by the rotation of these impellers.

According to a preferred way of carrying out the process, each impeller is composed of from two to six blades mounted equi-angularly from each other. Preferably the impellers are composed of three blades mounted at 120° from each other. In addition, the blades of the impellers have substantially the same length so that the circles produced by the rotation of these impellers have the same diameter. The impellers are mounted on a cylindrical shaft which is located centrally in the vat.

BRIEF DESCRIPTION OF THE DRAWINGS

FIG. 1 represents a longitudinal cutaway view of the device according to the present invention;

FIG. 2 represents the same device, but shows the view along line AA of FIG. 1;

DETAILED DESCRIPTION OF THE INVENTION

Figure 3:
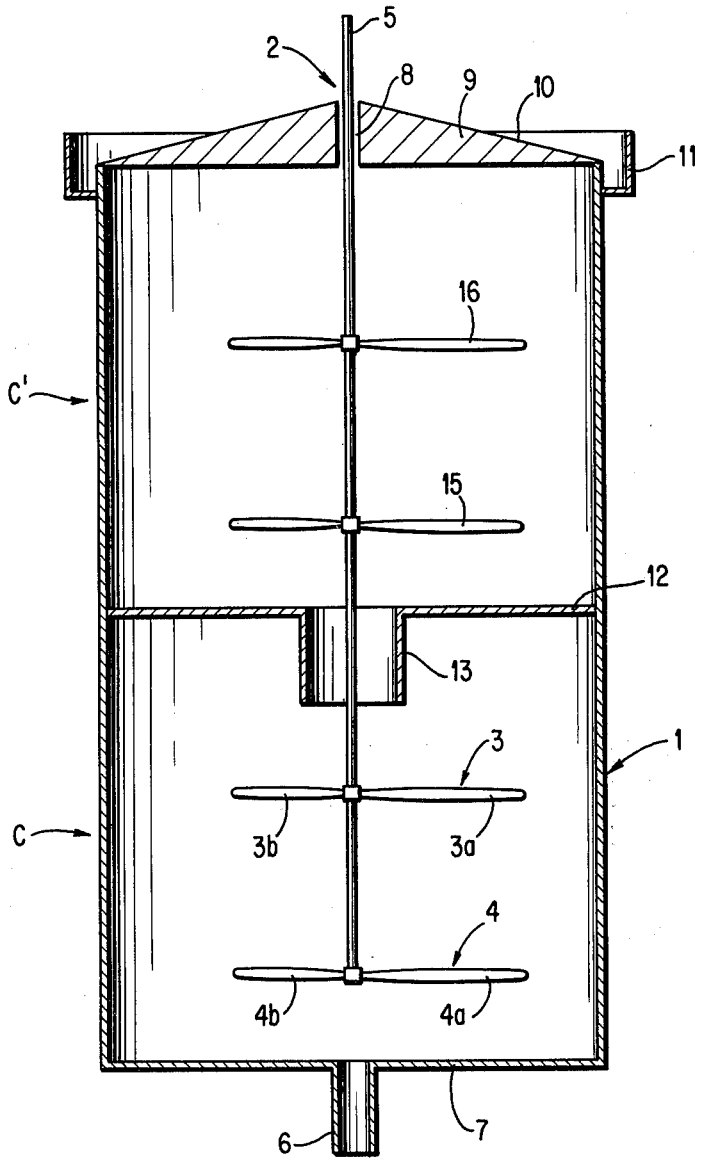
FIG. 3 shows, in a longitudinal cutaway drawing, how two interconnected vats may be arranged according to the present invention.

As shown in FIG. 1, the device according to the present invention includes a cylindrical vat, 1, furnished with an axial agitator, 2, including cylindrical shaft, 5, located at the center of the vat. Mounted on shaft 5 are a pair of impellers, 3 and 4, the blades of which extend substantially horizontally. The vat has a height to diameter ratio of from about 0.7 to about 1.5, preferably from about 0.9 to about 1.2.

Instead of a cylindrical vat, one may use a polyhedric vat, having six or more surfaces or sides. Preferably, the polyhedric vat has from 10 to 12 surfaces.

The impellers which are most suitable are those whose carrying coefficient, which is defined above, is constant over their length, and which produce substantially identical average speeds of pulp movement, regardless of the position of this moving mass on the impeller. Such a structure thus permits the minimization of turbulence, which is not necessary to carry out the attrition and which involves an unnecessary consumption of energy.

According to this method of carrying out the process, impellers 3 and 4 are each composed of three blades, 3*a*, 3*b*, 3*c* (not shown) and 4*a*, 4*b*, 4*c*, respectively, which are mounted at 120°, as represented in FIG. 2. These two impellers may, preferably, be arranged so that the axis of blade 3*a* be in the same plane as that, for example, of blade 4*a*. The pitch of the impeller blades is arranged so that impeller 3 (upper impeller) pumps the pulp towards the bottom of the vat, whereas impeller 4 (lower impeller) pumps the pulp towards the top of the vat.

As an example of such blades, one may cite those manufactured and sold by the firm S.E.M. (Société Européenne de Mélanges) under the commercial name of "SABRE" in different models.

When cylindrical shaft 5 is rotated, the ratio between the area of the surface of vat 1 (including that for the top and bottom covers 7 and 9), and the total surface described by both rotating impellers is from about 1.7 to about 2.4, and preferably from about 1.9 to about 2.1. According to the most preferred embodiment of the present invention, this ratio is equal to about 2.

If the vat is polyhedric, it is necessary to take into consideration the diameter of the inscribed circle. In such an event, this diameter is used to determine the vertical surface area of the vat.

The vertical distance between impellers 3 and 4 is from about 0.3 to about 0.7 times, preferably from about 0.4 to about 0.6 times the diameter of the circle which they describe during rotation.

The vertical distance between bottom 7, of vat 1, and lower impeller 4, in FIG. 1, is equal to about one-half of the diameter of the circle produced by the impellers during rotation. Bottom cover 7 may be planar or curved with the hollow facing upward, which improves the circulation of the pulp in the vat.

As for the vertical distance between upper impeller 3 and cover 9 of vat 1, it is substantially equal to the distance between the two impellers 3 and 4.

When in use, nickel ore in the form of pulp is introduced through conduit 6, which is connected to the lower side of the center opening of bottom 7 of vat 1. The dryness of this pulp, that is the weight percentage of dry matter in the pulp, must be at least equal to about 50%, and even be higher than 70% as far as possible. As for the ore itself, it must have as fine a particle size as possible. Thus, a particle size distribution such that 80% of the particles pass through a sieve whose openings are between 250 microns and 3 millimeters is considered satisfactory in this case.

The pulp is propelled, on the one hand, toward the top by lower impeller 4, and, on the other hand, toward the bottom by upper impeller 3. In this way, the mineral particles collide with each other in a zone situated about mid-distance between the two impellers 3 and 4. This collision causes a further break-down of the particles in the pulp.

The treated pulp is removed through conduit 8, located at the center of cover 9 of vat 1. One may then either introduce it into another vat to undergo a new attrition cycle, or direct it toward other devices.

According to the embodiment shown in FIG. 1, the pulp exits by overflowing the length of cone 10, which tops vat 1, and is recovered in gutter 11, situated around the exterior circumference of the top of the vat.

One may also pump the treated pulp by means of a conduit opening in the vat as close as possible to cylindrical shaft 5.

Conversely, conduit 8 may be used to introduce the pulp into vat 1, the treated pulp then flowing out through conduit 6 by the force of gravity.

Thus, in the case of a nickel ore, using a vat of 5 $m^3$, a return from attrition has been obtained on the order of 30% with a consumption of energy of 15 kilowatts per ton of ore treated, while the presently known conventional attrition devices entail a consumption on the order of 80 kilowatts per ton of treated ore.

As was mentioned earlier, in the case where the pulp must undergo another attrition cycle, this may take place in an independent vat. But this supplementary cycle may also be carried out in a second vat placed on top of the first, as represented in FIG. 3, with the pulp circulating in an ascending fashion. The first attrition chamber has been designated as "C," and the second as "C'." The vat has a total height-to-diameter ratio of from about 1.2 to about 3, preferably from about 1.8 to about 2.4.

Between these two attrition chambers, C and C', is placed partition 12, which divides the total volume of the vat into equal portions, forming chambers C and C' of equal volume. In the center of partition 12 is provided a cylindrical conduit opening towards the bottom, 13, possibly equipped with baffles which surround, without contact, shaft 5. This conduit 13, which is located within chamber C, permits the pulp of chamber C to pass into chamber C'. The length of this cylindrical conduit 13 is such that it penetrates into the vortex created by the agitation in chamber C.

Chamber C' also includes a pair of impellers 15 and 16, identical to that of chamber C. In FIG. 3, the same elements as those of FIG. 1 carry the same numbers for reference.

The vertical distances between the upper impeller 3 and partition 12, on the one hand, and between partition 12 and lower impeller 15, on the other, are identical to those described in the case of the single vat shown in FIG. 1. In addition, all of the dimensions and conditions described for the single vat in FIG. 1 are applicable to each of chambers C and C' in FIG. 3.

Experimental results show that when an ore is finely ground, that is when the grains have a diameter less than one millimeter, and when the quantity and the nature of the fine particles produced during attrition entail an important raising of the viscosity of the pulp, with the pulp then presenting a rheological behavior of pseudoplastic character, it is advantageous to induce a particular kind of circulation, such as that described above, for such pulp if it is desired to avoid the situation in which an important part of the product to be attritioned is not circulated through the impellers and then leaves the vat by overflowing, which notably decreases the efficiency of the attrition process.

This is why in the case of the nickel ore cited above as an example, it is necessary that the introduction and recovery conduits for the products be situated as close as possible to the axial agitator.

What is claimed is:

1. A process of wet attrition of ore comprising:

(a) grinding the ores to a pulp having a particle size distribution such that 80% by weight of the particles have a diameter from about 30 to about 0.4 mm; and (b) subjecting the pulp to wet attrition by agitating the pulp in a slightly turbulent medium, said agitation being conducted at an impeller Reynolds number of from about 1,000 to about 5,000, the impeller Reynolds number being defined as:

$$N_{ReImp}=(U\times d\times \rho)/\mu$$

wherein

U=rotational speed of the impeller, rpm;

$\rho$=density of the pulp being pumped, gm/cm$^3$;

d=diameter of the impeller, cm; and $\mu$=viscosity of the pulp being pumped, centipoise; the agitation of step (b) being carried out by stirring the pulp with at least two impellers mounted at a distance apart on a shaft, each of the impellers comprising at least two horizontally disposed blades, the blades having equal length and being so arranged that the impellers pump the preground ore towards the spaced defined between the impellers, the impellers having a carrying coefficient substantially constant throughout their length such that the voluminal flow rate per area element is constant whatever the position of this area element within the area produced by the rotation of each impeller.

2. The process of claim 1 wherein the percentage of dry matter in the pulp is at least 50% by weight.

3. The process of claim 2 wherein the percentage of dry matter is greater than 75% by weight.

4. The process of claim 1 wherein the impeller Reynolds number is from about 2,000 to about 4,000.

5. An apparatus for wet attrition of preground ore comprising a vat having a circular cross section, a height to diameter ratio of from about 1 to about 1.5, and top and bottom covers, and at least two impellers mounted at a distance apart on a shaft, each of the impellers comprising at least two horizontally disposed blades, the blades having equal length and being so arranged that the impellers pump the preground ore towards the space defined between the impellers, the distance between the impellers being from about 0.3 to about 0.7 times the diameter of the circle produced by the rotation of the impellers, the impellers having a carrying coefficient substantially constant throughout their length such that the voluminal flow rate per area element is constant whatever the position of this area element within the area produced by the rotation of each impeller.

6. The apparatus of claim 5 wherein the distance between the impellers in each pair of impellers is from about 0.4 to about 0.6 times the diameter of the circle produced by the rotation of the impellers.

7. The apparatus of claim 5 wherein the ratio of the areas of the total surface of one chamber of the vat to the surface of the circle produced by the rotation of the pair of impellers located in the same chamber of the vat is between about 1.7 and about 2.4.

8. The apparatus of claim 7 wherein this ratio is between about 1.9 and about 2.1.

9. The apparatus of claim 5 wherein the distance between the lower impeller in each chamber of the vat and the bottom of each of the chamber of the vat is substantially equal to about $\frac{1}{4}$ of the diameter of the circle produced by the rotation of the impellers.

10. The apparatus of claim 5 wherein each of the impellers comprises three blades mounted at 120° from each other.

11. The apparatus of claim 5 wherein the distance between the upper impeller and the top of each chamber of the vat is about half of the diameter of the circle produced by the rotation of the impellers.

12. An apparatus for wet attrition of preground ore comprising a vat having a circular cross section, a height to diameter ratio from about 1 to about 1.5, and top and bottom covers, and at least two impellers mounted at a distance apart on a shaft, connected to a tubular conduit, each of the impellers comprising at least two horizontally disposed blades, the blades having equal length and being so arranged that the impellers pump the preground ore towards the space defined between the impellers, the impellers having a carrying coefficient substantially constant throughout their length such that the voluminal flow rate per area element is constant whatever the position of this area element within the area produced by the rotation of each impeller.

13. The apparatus of claim 12 wherein the distance between the impellers in each pair of impellers is from about 0.4 to about 0.6 times the diameter of the circle produced by the rotation of the impellers.

14. The apparatus of claim 13 wherein the ratio of the areas of the total surface of one chamber of the vat to the surface of the circle produced by the rotation of the pair of impellers located in the same chamber of the vat is between about 1.7 and about 2.4.

15. The apparatus of claim 14 wherein this ratio is between about 1.9 and about 2.1.

16. The apparatus of claim 12 wherein the distance between the lower impeller in each chamber of the vat and the bottom of each of the chamber of the vat is substantially equal to about $\frac{1}{4}$ of the diameter of the circle produced by the rotation of the impellers.

17. The apparatus of claim 12 wherein each of the impellers comprises three blades mounted at 120° from each other.

18. The apparatus of claim 12 wherein the distance between the upper impeller and the top of each chamber of the vat is about half of the diameter of the circle produced by the rotation of the impellers.

* * * * *

UNITED STATES PATENT AND TRADEMARK OFFICE

CERTIFICATE OF CORRECTION

PATENT NO. : 4,434,942

DATED : Mar. 6, 1984

INVENTOR(S) : Jean-Louis CARDINI

It is certified that error appears in the above-identified patent and that said Letters Patent is hereby corrected as shown below:

On the title page:

Line "[73] Assignee" the assignee's name should read

-- Societe Metallurgique le Nickel - S.L.N. --.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*